US009677396B2

(12) United States Patent
Godager

(10) Patent No.: US 9,677,396 B2
(45) Date of Patent: Jun. 13, 2017

(54) METHOD AND APPARATUS FOR PERMANENT MEASUREMENT OF WELLBORE FORMATION PRESSURE FROM AN IN-SITU CEMENTED LOCATION

(71) Applicant: SENSOR DEVELOPMENTS AS, Sandefjord (NO)

(72) Inventor: Øivind Godager, Sandefjord (NO)

(73) Assignee: Sensor Developments AS, Sandefjord (NO)

( * ) Notice: Subject to any disclaimer, the term of this patent is extended or adjusted under 35 U.S.C. 154(b) by 404 days.

(21) Appl. No.: 14/225,266

(22) Filed: Mar. 25, 2014

(65) Prior Publication Data

US 2015/0007976 A1 Jan. 8, 2015

(30) Foreign Application Priority Data

Jul. 8, 2013 (NO) ..... 20130949

(51) Int. Cl.

| | |
|---|---|
| ***E21B 47/06*** | (2012.01) |
| ***E21B 33/14*** | (2006.01) |
| ***E21B 47/00*** | (2012.01) |
| ***E21B 47/01*** | (2012.01) |

(52) U.S. Cl.

CPC ..... *E21B 47/065* (2013.01); *E21B 33/14* (2013.01); *E21B 47/0005* (2013.01); *E21B 47/01* (2013.01); *E21B 47/06* (2013.01)

(58) Field of Classification Search

CPC .... E21B 33/14; E21B 47/0005; E21B 47/065; E21B 47/06; E21B 47/01

See application file for complete search history.

(56) References Cited

U.S. PATENT DOCUMENTS 3,744,307 A * 7/1973 Harper ..... E21B 47/06 73/152.51
3,915,010 A * 10/1975 Tricon ..... E21B 47/06 73/729.2
4,453,401 A 6/1984 Sidey
(Continued)

FOREIGN PATENT DOCUMENTS

| | | |
|---|---|---|
| WO | 2007056121 | 5/2007 |
| WO | 2012073145 | 6/2012 |
| WO | 2013052996 | 4/2013 |

OTHER PUBLICATIONS

Norwegian Search Report dated Feb. 8, 2014 for Application No. 20130949.

(Continued)

*Primary Examiner* — Jennifer H Gay

(57) ABSTRACT

A pressure gauge system and a method for in-situ determination of a wellbore formation pressure through a layer of cement, where the pressure gauge system comprises: a housing arranged to be permanently installed in the cement on the outside of a wellbore casing, wherein said housing comprises a pressure sensor with an output pressure signal, wherein: the pressure gauge system further comprises: a first temperature sensor with a first temperature signal, a second temperature sensor with a second temperature signal; and a computer implemented compensation means arranged to receive the pressure signal, the first and second temperature signals, and calculate a temperature compensated output pressure signal.

13 Claims, 6 Drawing Sheets

(56) References Cited

U.S. PATENT DOCUMENTS 4,475,591 A 10/1984 Cooke, Jr.
4,782,694 A * 11/1988 Dennis ..... G01L 19/0636 210/489
5,467,823 A 11/1995 Babour et al.
6,125,935 A 10/2000 Shahin, Jr.
6,279,392 B1 8/2001 Shahin, Jr. et al.
6,439,055 B1 * 8/2002 Maron ..... G01L 9/06 73/705
6,978,833 B2 * 12/2005 Salamitou ..... E21B 47/01 166/250.11
6,994,167 B2 * 2/2006 Ramos ..... C04B 24/003 166/173
7,151,377 B2 * 12/2006 Chouzenoux ..... E21B 17/003 324/368
7,219,729 B2 * 5/2007 Bostick, III ..... E21B 21/08 166/242.1
7,997,340 B2 * 8/2011 Bostick, III ..... E21B 21/08 166/250.01
8,297,353 B2 * 10/2012 Roddy ..... E21B 33/13 166/250.14
8,540,027 B2 * 9/2013 Wesson ..... E21B 43/114 166/298
8,683,859 B2 * 4/2014 Godager ..... E21B 41/0085 73/152.54
8,689,621 B2 * 4/2014 Godager ..... E21B 41/0085 73/152.54
8,912,852 B2 * 12/2014 Godager ..... E21B 47/06 331/176
2002/0048135 A1 * 4/2002 Lerche ..... B82Y 10/00 361/247
2004/0112595 A1 * 6/2004 Bostick, III ..... E21B 21/08 166/250.01
2004/0180793 A1 * 9/2004 Ramos ..... C04B 24/003 507/200
2006/0090892 A1 * 5/2006 Wetzel ..... E21B 47/01 166/250.01
2007/0139217 A1 6/2007 Beique et al.
2007/0193740 A1 * 8/2007 Quint ..... E21B 43/119 166/250.07
2008/0053658 A1 * 3/2008 Wesson ..... E21B 43/114 166/297
2008/0307877 A1 * 12/2008 Cook ..... E21B 43/11 73/152.57
2009/0038793 A1 * 2/2009 Schmitt ..... E21B 47/121 166/250.01
2011/0186294 A1 8/2011 Narvaez et al.
2011/0192598 A1 * 8/2011 Roddy ..... E21B 33/13 166/253.1
2012/0017673 A1 * 1/2012 Godager ..... E21B 41/0085 73/152.51
2012/0024050 A1 2/2012 Godager
2012/0306581 A1 12/2012 Godager
2013/0110402 A1 * 5/2013 Godager ..... E21B 47/122 702/7
2014/0318771 A1 * 10/2014 Gray ..... E02D 33/00 166/250.14
2015/0007976 A1 * 1/2015 Godager ..... E21B 33/14 166/64

OTHER PUBLICATIONS

Patent Cooperation Treaty International-Type Search Report dated Feb. 6, 2014 for Application No. 20130949.

* cited by examiner

1

METHOD AND APPARATUS FOR PERMANENT MEASUREMENT OF WELLBORE FORMATION PRESSURE FROM AN IN-SITU CEMENTED LOCATION

CROSS-REFERENCE TO RELATED APPLICATIONS

This application claims benefit of Norwegian patent application number 20130949, filed Jul. 8, 2013, which is herein incorporated by reference.

BACKGROUND OF THE INVENTION

Field of the Invention

The present invention relates to an in-situ method and system for measuring wellbore pressures in a formation. More specifically, a pressure gauge is arranged to be permanently cemented in place outside of a wellbore conduit, and pressure measurements signals representing the formation pressure are sent to a control unit.

Description of Prior Art

Different technologies can be applied for measurement of the pressure in the formation surrounding the wellbore, but in general some type of a pressure gauge is arranged in the formation, or in contact with the formation.

International patent publication WO2007/056121 A1 discloses a method for monitoring formation pressure, where the gauge is shot from a gun attached to the wellbore conduit through the cement and into the formation.

International publication WO2012073145 A1 discloses a method for measuring pressure in an underground formation by establishing a flowline and a piston to suction fluid into a test chamber.

International publication WO2013052996 discloses a method for installing a pressure transducer in a borehole, where a fluid connection between the transducer and the sensor is established through the cement.

U.S. Pat. No. 5,467,823 shows a method and apparatus of monitoring subsurface formations by means of at least one sensor responsive to a parameter related to fluids, comprising the steps of: lowering the sensor into the well to a depth level corresponding to the reservoir; fixedly positioning the sensor at the depth while isolating the section of the well where the sensor is located from the rest of the well and providing fluid communication between the sensor and the reservoir by perforating the cement.

In general all permanent pressure gauges have a sensor, a fluid fill, and a process isolation system. The sensor is often a quartz crystal resonator sensor. The process isolation system protects the oil around the sensor itself, as this needs to be in an oil filled and inert medium to measure the pressure in the fluid. The isolation system may typically be established by a bellows or using a diaphragm or by one or more relatively large oil volume oil chambers in series separated by a buffer tube system.

The negative side of using a diaphragm is that a relatively wide area diaphragm is needed to provide effective and sufficient volume compensation of the oil fill surrounding the sensor. In turn, a larger area diaphragm is vulnerable to damage and overexposure of its dynamic range.

Buffer tubes are coiled pieces of tubing that are attached to the sensor port. The buffer tube serves as a mechanical isolator to prevent shock or vibration from being transmitted directly to the sensor. However, buffer tubes in series with one or more coupled oil chambers is not really an isolation system as oil is in a continuous contact from the outside and inward to the sensor. Another related problem is that the buffer tubes may clog up with time.

U.S. Pat. No. 4,453,401 shows a system for measuring transient pore water pressure in the ground utilizes a probe member with an arrangement of a pressure sensor and a soil stress isolation filter. The probe member has a body portion with a hollow cavity defined therein. The pressure sensor in the form of a ceramic transducer is mounted in the cavity.

The use of bellows are known from prior art. However, in a traditional pressure gauge configuration, the pressure port of the pressure gauge housing is open to the environment. In turn, this exposes the bellows to the fluids of the surroundings without being filtered. This typically lead to deposition of sediments in the chamber housing the bellows, which inhibits it freedom to move with time or in worst case becoming non-functional as an elastic element transferring the pressure from the outside to the inside. The latter is typically the case if the sensor is placed in a location that is being cemented. Cement will fill the housing surrounding the bellows and as it hardens the pressure gauge will be isolated and disabled to see the pressure change on the outside wellbore or formation, as the bellows is no longer able to work as an elastic element.

SUMMARY OF THE INVENTION

A main object of the present invention is to disclose a method and a system for in-situ determination of a wellbore formation pressure without having to establish a fluid connection between the pressure gauge and the formation by perforating the cement according to prior art.

Another objective of the invention is to improve the responsiveness of the measurements of the proposed solution, so that the measured pressure reflects the actual formation pressure in real time.

In an embodiment the invention is a pressure gauge system for in-situ determination of a wellbore formation pressure through a layer of cement, the pressure gauge system comprising:

- a housing arranged to be permanently installed in the cement on the outside of a wellbore casing, comprising:
  - a pressure sensor with an output pressure signal; wherein the pressure gauge system further comprises;
  - a first temperature sensor with a first temperature signal arranged to measure a first temperature outside the wellbore casing; and
  - a computer implemented compensation means arranged to receive the pressure signal and the first temperature signal, and calculate a temperature compensated output pressure signal.

The invention is also a method for in-situ determination of a wellbore formation pressure through a layer of cement (22), wherein the method comprises the following step:

detecting an output pressure signal (6*s*) from a pressure sensor (6) arranged in a housing (5) permanently installed in the cement (22) on the outside of a wellbore casing (16);

detecting a first temperature signal (51*s*) from a first temperature sensor (51) arranged to measure a first temperature outside the wellbore casing (16); and calculating a temperature compensated output pressure signal (p) in a computer implemented compensation means (60), based on the pressure signal (6*s*) and the first temperature signal (s).

According to an embodiment of the invention, the accuracy and response of pressure measurement can be further improved when the pressure gauge system, comprises a second temperature sensor (47) with a second temperature signal (47*s*) arranged to measure a second temperature inside the wellbore casing (16), wherein the computer implemented compensation means (60) is arranged to receive the second temperature signal (s), and calculate the temperature compensated output pressure signal (p) also based on the second temperature signal (47*s*).

The second temperature sensor (47) detects the temperature variations before they penetrate to the location of the pressure gauge and will in this embodiment be used to predict temperature changes before they actually occur.

Further the invention discloses solutions for enhancing the performance of the pressure sensor to be encapsulated in cement, such as oil filled chambers separated by a bellows to separate the oil around the pressure sensor from the oil in hydraulic communication with the formation, and a wetted filter port that will hider cement from entering the housing in its liquid phase. This will grant the dynamic properties of the bellows in order to couple pressures from the outside to the inside of pressure sensing system. Further, the filter port will enable hydraulic conductivity with the saturated cement.

BRIEF DESCRIPTION OF THE DRAWINGS

The attached figures illustrate some embodiments of the claimed invention.

DETAILED DESCRIPTION

The invention will in the following be described and embodiments of the invention will be explained with reference to the accompanying drawings.

Figure 1:
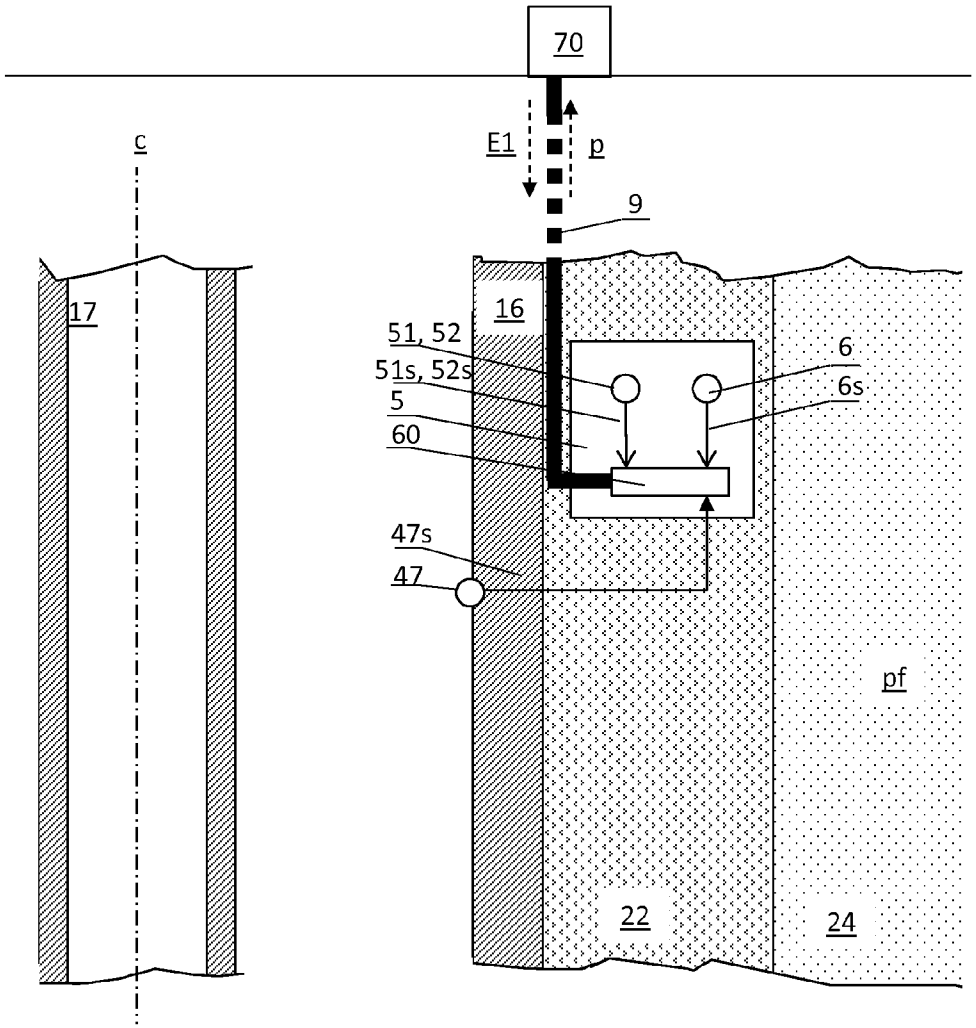
FIG. 1 is a simplified section view of a wellbore installation with a pressure gauge system illustrated as a block diagram according to an embodiment of the invention.

FIG. 1 is a sectional view combined with a block diagram of a wellbore where the pressure gauge system (1) is installed according to an embodiment of the invention.

The dotted, vertical line (c) illustrates the center of the wellbore, and a tubing (17), such as a production tubing, runs through the wellbore. The terms outside and inside used in the document refers to positions relative the vertical center line (c). E.g outside the tubing (17) means outside the casing wall with reference to the center line (c), which is inside the tubing (17).

Outside the tubing (17) there is a casing (16) shown to the right. The left side of the casing (16) is not shown in this sectional view, but it will be understood that the casing surrounds the tubing (17).

Between the casing (16) and the formation (24) there is a layer of cement (22) to stabilize and fasten the casing (16) in the wellbore.

The pressure gauge system (1) for in-situ determination of a wellbore formation pressure through a layer of cement (22), comprises in this embodiment:

a housing (5) arranged to be permanently installed in the cement (22) on the outside of a wellbore casing (16), wherein said housing comprises;

a pressure sensor (6) with an output pressure signal (6*s*), wherein the pressure gauge system (1) further comprises;

a first temperature sensor (51) with a first temperature signal (51*s*) arranged to measure a first temperature outside the wellbore casing (16); and a computer implemented compensation means (60) arranged to receive the pressure signal (6*s*) and the first temperature signal (51*s*), and calculate a temperature compensated output pressure signal (p).

The invention is also in an embodiment a method for in-situ determination of a wellbore formation pressure through a layer of cement (22), wherein the method comprises the following steps:

detecting an output pressure signal (6*s*) from a pressure sensor (6) arranged in a housing (5) permanently installed in the cement (22) on the outside of a wellbore casing (16);

detecting a first temperature signal (51*s*) from a first temperature sensor (51) arranged to measure a first temperature outside the wellbore casing (16); and calculating a temperature compensated output pressure signal (p) in a computer implemented compensation means (60), based on the pressure signal (6*s*) and the first temperature signal (s).

When the housing (5) with the pressure sensor (6) is arranged inside the cement (22), the formation (24) and the fluids of the formation will be in hydraulic conductivity with the pressure sensor (6) through the cement (22), or any other saturated layer of porous matrix media.

Any measurement of the formation pressure will depend on the temperature of the housing (5) in thermal contact with the cement (22) and the surrounding formation (24). An increase in temperature of the cement (22) would therefore result in an increase in pressure that may not reflect the real pressure in the formation (24), since the temperature of the cement (22) may also depend on the temperature of the wellbore and cavity (16).

The formation pressure detected by the pressure sensor (6) will depend on the temperature of the surrounding cement (22) and. Thus, the detected pressure is partly thermally induced.

The first temperature sensor (51) is used to compensate for pressure variations resulting from local temperature variations.

Knowing that there is an inherent hydraulic conductivity issue in order to measure true formation pressure due to thermally induced pressures within the pressure sensor and boundary cement, an adaptive method is required to filter and compensate such effects. This is done in time domain using knowledge of the physical model of the hydraulic system of the housing (5) of the pressure gauge system (1), some knowledge of the specific cement (22), which can be obtained by analyzing samples, and deriving a transfer function in terms of ambient pressure and temperature measured by the pressure sensor (6) in response to rate of temperature change with time.

A correction can be obtained by applying the transfer function to the output pressure signal (6*s*) to filter and correct it accordingly so that the resulting, or temperature compensated output pressure signal (p) is less affected by thermally induced changes to the pressure felt by the pressure sensor (6).

The temperature compensated output pressure signal (p) will represent a more correct pressure in the formation (24) at any change of operating conditions affecting the pressure gauge system (1) and its relatively closed sensor system in the housing (5).

Figure 6:
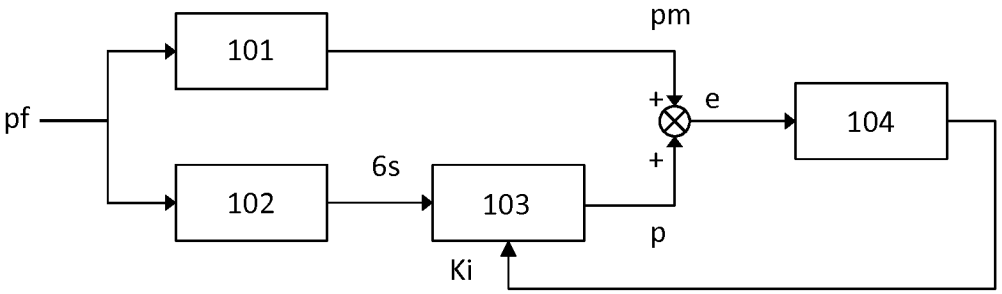
FIG. 6 is a block diagram of adaptive correction of the pressure measurement according to an embodiment of the invention

An example of the use of transfer function for correction of the pressure measurement according to an embodiment of the invention is illustrated in the block diagram of FIG. 6. This block diagram illustrates an embodiment of the computer implemented compensation means (60).

The real formation pressure (pf) is input to the system transfer model (101) representing the wellbore. This model is developed based on the knowledge of the wellbore characteristics. The output of the transfer function (101) will be a modeled formation pressure (pm).

The other branch represents the real transfer system (102), i.e. the transfer from the real formation pressure (pf) to the sensed pressure (6*s*).

The correction module (103) will calculate the temperature compensated output pressure signal (p). If there is no compensation, the difference (e) will be the difference between the modeled formation pressure (pm) and the sensed pressure (6*s*). The difference (e) will vary with the temperature difference between the formation temperature and the temperature of the pressure sensor (6).

This difference (e) should be as small as possible, and a computing module (104) is arranged to control the values of the correction module (103) to minimize this difference (e).

The optimization parameter (Ki) of the correction module (103) is continuously controlled and set to a value to minimize the difference (e).

According to an embodiment of the invention the pressure gauge system (1) has its own built-in pressure sensor (6) and first temperature sensor (51) element with a frequency output signal like those from crystalline quartz resonators.

According to an embodiment of the invention the pressure gauge system (1) comprises a rate of change temperature sensor (52) with rate of change temperature signal (52*s*) arranged to measure a rate of change of the first temperature outside the wellbore casing (16), wherein the computer implemented compensation means (60) is arranged to receive rate of change temperature signal (52*s*).

The rate of change of the first temperature may in an embodiment be calculated statistically based on the change of the first temperature signal with time, using the first temperature sensor (51).

Thus, in an embodiment the method according to the invention comprises the steps of:

detecting a rate of change of the first temperature in a rate of change temperature sensor (52) with a rate of change temperature signal (52*s*); and calculating the temperature compensated output pressure signal (p) in the computer implemented compensation means (60) also based on the rate of change temperature signal (52*s*).

Typically, the calculation of the formation pressure (p) as indicated above, will exhibit a small to medium lag of compensation and effectiveness. This is mainly caused by the properties and the placement of the first temperature sensor (51) inside the cement (22). Moreover, the gross offsets due to the change in temperature may be corrected, but the fact that a change actually must have taken place in order to be measured, will significantly slow down the speed and response to correct the formation pressure (p). Due to the relatively slow response, the formation pressure (p) will usually be offset with regard to the true formation pressure as long as the temperature is changing, since the correction only takes place when there is an offset as a result of some change in a wellbore parameter.

To further improve the correctness of the pressure measurements a second temperature sensor (47) is used in an embodiment of the invention. Please see FIG. 1. The second temperature sensor (47) is arranged to sense a second temperature inside the wellbore casing (16), and use the second temperature, in addition to the first temperature, as an input to an alternative correction model, called the feed-forward correction model.

This improves the response and almost eliminates the phase lag and resulting offsets that was described above for the adaptive correction model.

In general the source of temperature disturbance or changes in a well is related to changes in load/process conditions occurring coaxially in the center core or conduit of the well, e.g. in the tubing (17) and/or in the annulus outside the tubing (17). Thus a change in load in the center of the well radially influences the temperature of the surrounding casing (16), cement (22) and formation (24). Depending on the temperature of the core relative the surrounding temperature, the energy will be transported either into, or out of the well by the flow of the process medium.

Thus, looking at FIG. 1, it may be seen that by placing a second temperature sensor (47) closer to the production tubing (17) or conduit in the well this sensor will pick up a change in the temperature due to changes in medium flow, composition or load much faster than the first temperature sensor (51) grouted in the cement (22) at the exterior of the wellbore casing (16). Consequently, when a change in the second temperature is detected, we may predict that there will be a change to come in the coaxial radii of the well, i.e. outside the casing (16) and in the cement (22) where the pressure sensor (6) is located.

According to an embodiment, the second temperature signal (47*s*) from the second temperature sensor (47) of the pressure gauge system (1) will be used for correction of the output pressure signal (6*s*) from the pressure sensor (6).

The second temperature sensor (47) is arranged to measure a second temperature inside the wellbore casing (16), wherein the computer implemented compensation means (60) is arranged to receive the second temperature signal (47*s*), and calculate the temperature compensated output pressure signal (p) based on the pressure signal (6*s*), the first temperature signal (51*s*) and the second temperature signal (47*s*).

The corresponding method comprises the steps of;

detecting a second temperature signal (47*s*) from a second temperature sensor (47) arranged to detect a second temperature inside the wellbore casing (16), and;

calculating the temperature compensated output pressure signal (p) in the computer implemented compensation means (60) based on the pressure signal (6*s*), the first temperature signal (51*s*) and the second temperature signal (47*s*).

In an embodiment the computer implemented compensation means (60) is arranged inside the housing (5) outside the casing (16), and the solution may be referred to as an adaptive feed-forward correction model, since information about changes in the conditions related to the process taking place in the center of the wellbore is dynamically relayed to the remote housing (5) before the change has progressed to the outer radii and the remote housing (5). Due to wellbore geometry and configurations, a well temperature profile from center and outwards, will be mostly affected by the conduit and intermediate fluid masses as temperature in the flowing conduit change. Consequently, the most dominating parameter that control the rate of temperature change, are those related to masses involved as the masses will exhibit thermal inertia.

Thus, using the second temperature sensor (47) inside the well sensing the process where the changes take place and feeding information of a change in progress to a more remote pressure sensor (6) and correction means, such as the computer implemented compensation means (60) will be valuable feed-forward information to the latter for noise removal.

As the pressure gauge system (1) has an encapsulated volume of oil as previously described, a thermally induced pressure will be generated and the output pressure signal (6*s*) will change consequently. Knowing the properties of at least the dead volume of the oil encapsulated in the first oil filled chamber (8) and physical properties of the boundary cement (22), the resulting thermally induced pressure may be corrected ahead of a change by the adaptive feed-forward correction model, removing any apparent "false" thermally induced pressure.

Based on the above description of continuous control of the parameter Ki, the feed forward correction system will now be explained.

Figure 7:
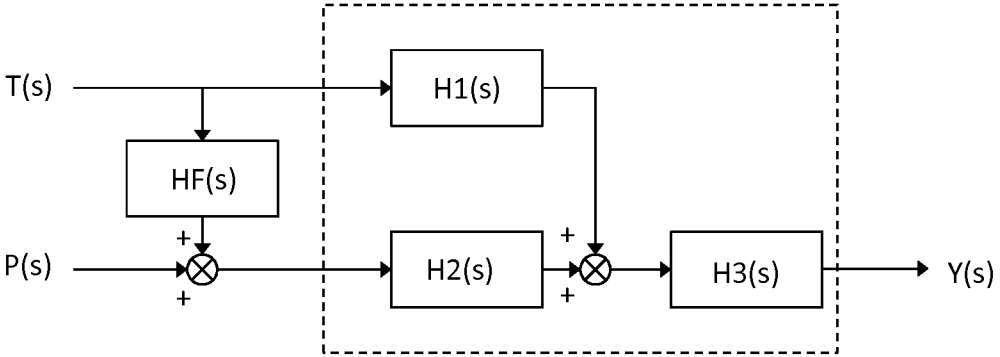
FIG. 7 is a block diagram of feed forward correction of the pressure measurement according to the invention.

Feed-forward correction technique is a good approach to eliminate and remove the influence of noise on a measurement parameter, e.g. pressure, and will increase the response of the pressure gauge system (1) in projecting the correct formation pressure (pf) outside the cement (22). In FIG. 7 it is illustrated in a block diagram how the feed-forward correction technique may be applied to remove thermally induced pressures, i.e. noise, and thereby enhancing the measurements of the real formation pressure. The model is a Laplace transform of the time domain into the frequency domain, where the parameter s is a complex number as will be understood by a person skilled in the art. In the figure, the following blocks are illustrated; La Place transformed thermally induced pressure (H1(*s*)), Hydraulic diffusivity (H2(*s*)), Sensor resonator (H3(*s*)) and Feed forward correction (HF(s)). T(s), P(s) and Y(S) are the Laplace transformed temperature, pressure and output, respectively. The stapled line illustrates the pressure gauge system (1).

If the effect of the noise should be fully removed the following expression is valid:

$$Y(s)=H_1 \cdot H_3 \cdot \mathrm{Temp}(s)+H_F \cdot H_2 \cdot H_3 \cdot \mathrm{Temp}(s)=0 \tag{1.1}$$

This gives us $$H_F(s) = -\frac{H_1(s)}{H_2(s)} \tag{1.2}$$

A system realized according to equation 1.2 would be an optimal correction model or solution. To accomplish this, we should comply with the following theorems:

The noise must be measurable. The sensor resonator model (HF(s)) should include the transfer function of the sensing element;

We need to know the transfer function of the thermally induced pressure (H1(*s*)) and hydraulic diffusivity (H2(*s*)); and The sensor resonator model (HF(s)) must be realizable.

If we set s=0 in equation 1.2, we achieve the static feed-forward condition:

$$H_F(0) = -\frac{H_1(0)}{H_2(0)}$$

It should be noted that, even if not all the conditions stated in the second and third bullet points are possible to accomplish in a given wellbore, a significant response improvement may still be achieved.

In FIG. 1 a physical arrangement of the pressure gauge system (1) according to an embodiment of the invention is shown.

The pressure gauge system (1) comprises:

a first end of a cable (9) connected to the computer implemented compensation means (60), wherein the cable (9) is arranged for transferring electric power (E1) to the computer implemented compensation means (60); and a second end of the cable (9) connected to a control unit (70) arranged to receive the output pressure signal (p) from the computer implemented compensation means (60). The second temperature sensor (47) can be seen arranged on the inside of the casing (16) in communication with the computer implemented compensation means (60).

In the arrangement described above, the cable runs along the outside of the casing (16) up to a control unit (70). There are certain problems related to the installation of a cable (9) outside the casing (16), the arrangement and maintenance of the second temperature sensor (47) inside the casing wall, and the termination of the cable (9) in the control unit (70) on top of the outer casing (16).

Figure 2:
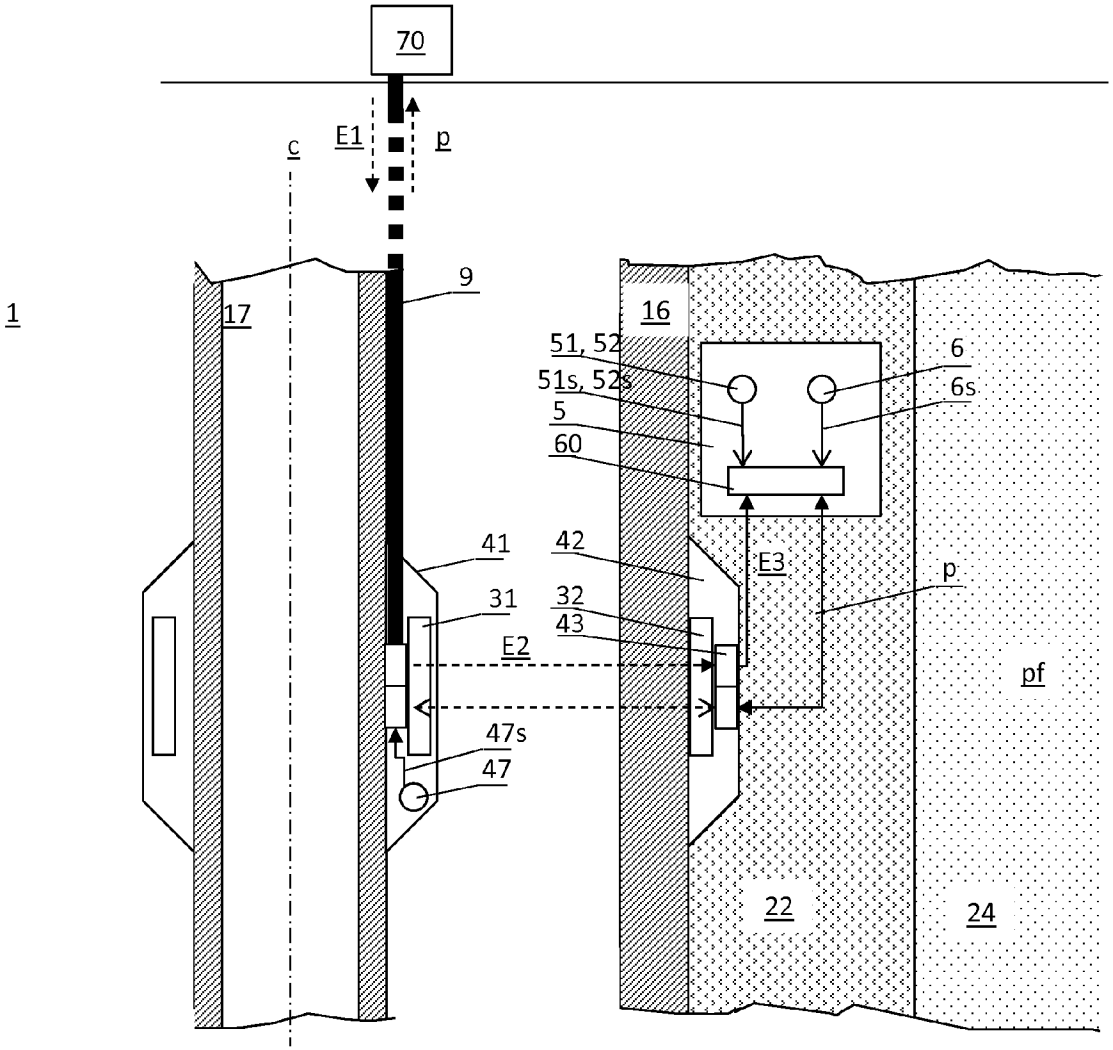
FIG. 2 is a simplified section view of a wellbore installation with a pressure gauge system comprising wireless transfer means according to an embodiment of the invention.

An improved arrangement according to an embodiment of the invention is shown in FIG. 2, where the cable run along the tubing (17) and inductive transfer is used for both power supply and signal communication between the housing (5) and the control unit (70). In addition the second temperature signal (47*s*) from the second temperature sensor (47) is also sent over the wireless interface from the tubing (16) to the casing (16). Thus the second temperature sensor (47*s*) can be arranged closer to where the temperature changes occur.

In this embodiment the pressure gauge system (1) comprises:

an outer wellbore instrument (42) comprising an outer inductive coupler (32), wherein the outer wellbore instrument (42) is fixed arranged to the wellbore casing (16);

an inner wellbore instrument (41) comprising an inner inductive coupler (31) arranged on the outside of a tubing (17) arranged inside the wellbore casing (16);

a first end of a cable (9) connected to the inner wellbore instrument (41), wherein the cable (9) being arranged for transferring electric power (E1) to the inner wellbore instrument (41), and the inner wellbore instrument (41) is arranged to provide inductive power (E2) to the outer wellbore instrument (42), wherein the outer wellbore instrument (42) comprises power means (43) for power harvesting the inductive power (E2) and for providing power (E3) to the computer implemented compensation means (60); and a second end of the cable (9) connected to a control unit (70) arranged to receive the output pressure signal (p) from the computer implemented compensation means (60) via the outer wellbore instrument (42) and the inner wellbore instrument (41).

The corresponding method comprises the steps of:

providing power (E3) to the computer implemented compensation means (60), via a cable (9), an inner wellbore instrument (41), and an outer wellbore instrument (42); and receiving the output pressure signal (p) from the computer implemented compensation means (60) via the outer wellbore instrument (42), the inner wellbore instrument (41) and the cable (9), wherein a second end of the cable is connected to a control unit (70).

The wellbore instrument (42) may be arranged inside the casing (16). However, this means that the casing (16) must be penetrated by power and communication lines to communicate with the components outside the casing (16). The wellbore instrument (42) would also make completion more difficult when it is arranged on the inside of the wall. It may also be entirely or partly arranged within the casing wall, i.e. in a cavity of the wall. However, a more advantageous solution is to arrange the wellbore instrument (42) outside the casing (16). In this embodiment the wellbore casing (16) has a relative magnetic permeability less than 1.05 in a region between the inner wellbore instrument (41) and the outer wellbore instrument (42).

Figure 3:
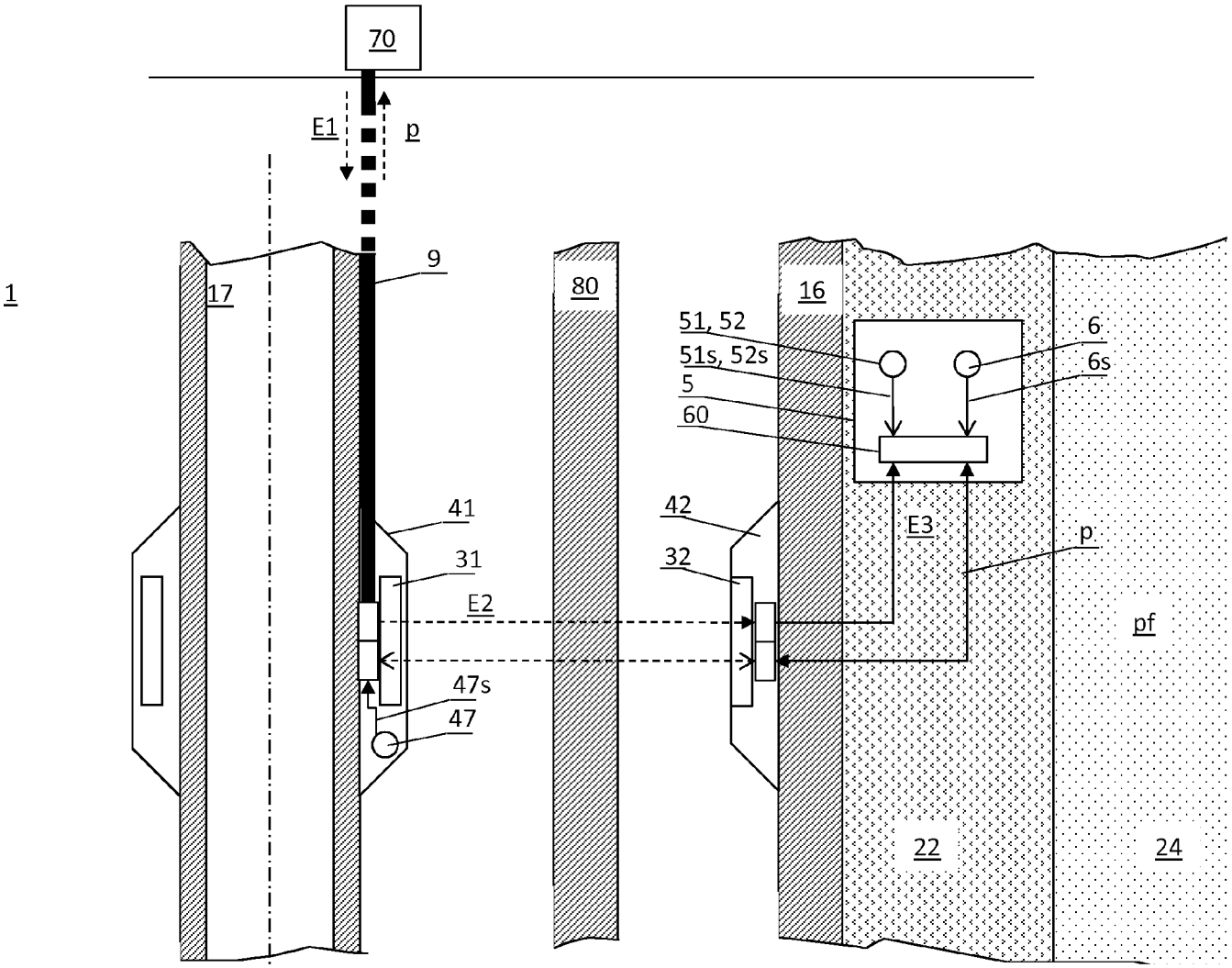
FIG. 3 is a simplified section view of a wellbore installation with a pressure gauge system comprising wireless transfer means across an intermediate casing according to an embodiment of the invention.

The invention may also be applied where there is more than one annulus between the second temperature sensor (47) and the housing (5) as illustrated in FIG. 3, showing an intermediate casing (80) between the tubing (17) and the casing (16). This may be e.g. a barrier that should not be broken.

In this embodiment the pressure gauge system (1) comprises an intermediate casing section (80) coaxially arranged between the wellbore casing (16) and the tubing (17), wherein the intermediate casing section (80) has a relative magnetic permeability less than 1.05. The outer wellbore instrument (42) should in this embodiment preferably be arranged inside the casing (16) or partly or completely in a cavity of the inner wall of the casing (16) to reduce signal attenuation through solid walls.

In an embodiment the second temperature sensor (42) is arranged inside the tubing (17). This could be performed by an additional inductive coupler inside the tubing (17), and a relative magnetic permeability of less than 1.05 in a region of the tubing (17) between the additional inductive coupler and the inner wellbore instrument (41).

Alternatively, the tubing wall could be to allow a physical connection.

Figure 4:
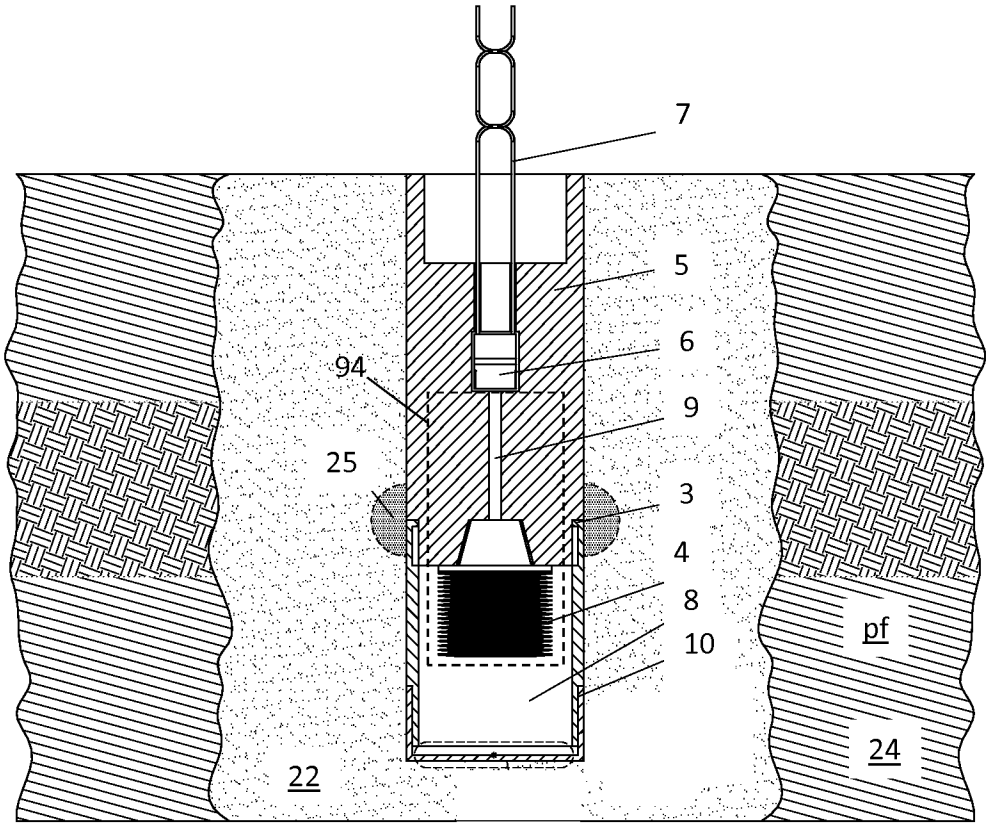
FIGS. 4 and 5 illustrates a housing of the pressure gauge system.
Figure 5:
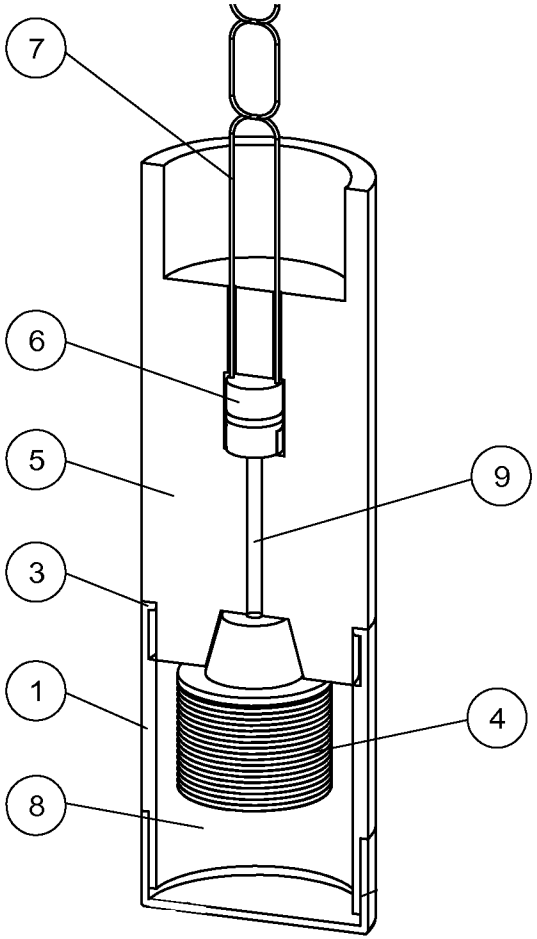

In order to take advantage of the hydraulic conductivity through a saturated layer of porous matrix media like cement (22), certain features of the pressure gauge system (1) according to the invention are advantageous for long term stable measurements, please see FIGS. 4 and 5 showing details of the housing (5).

According to an invention the housing (5) comprises:

a first oil filled chamber (8):

a pressure transfer means (94) between the first oil filled chamber (8) and the pressure sensor (6), arranged to isolate the pressure sensor (6) from the oil filled chamber (8); and a pressure permeable filter port (3) through the housing (5) to allow formation pressure from outside the housing (5) to act on the first oil filled chamber (8).

Thus, the pressure inside the first oil filled chamber (8) will be the same as the pressure outside the housing (5) since a pressure connection has been established through the filter port (3), and formation pressure (pf) will be transferred into the first filled oil chamber (8) by hydraulic connectivity through the layer of cement (22), via the filter port (3). In this way the internal fluid inside the housing (5) will be hydraulically balanced with the wellbore formation (24).

The pressure transfer means (94) transfers the pressure of the first filled oil chamber (8) to the pressure sensor (6). In an embodiment the pressure transfer means (94) comprises a second oil filled chamber (9) partly constituted by a second side or interior part of a non-permeable bellows (4), where a first side, or an outer part of the bellows is arranged to reside in the first oil filled chamber (8), and an oil in the second oil filled chamber (9) is in fluid contact with the pressure sensor (6).

In this embodiment the pressure sensor (6) is in fluid contact with the fluid in the second oil filled chamber (9), and detects pressure changes in the second oil filled chamber (9).

The non-permeable bellows (4) isolates the pressure sensor (6). Its purpose is to avoid contamination of second oil filled chamber (9) inside the housing (5) from being mixed with fluids from the surrounding formation (24).

The permeable filter port (3) is the hydraulic gateway connecting first oil filled chamber (8) to the surrounding formation (24) and automatically equalizes any pressure difference between sensor filter port (3) and the exterior formation pressure (24).

In an embodiment the filter port (3) is one or more slits through the housing (5).

The filter port (3) is preferably filled with pressure permeable material saturated by a buffer fluid, typically a filling of viscous oil, which provides an excellent pressure transfer fluid to the port surroundings (25).

Moreover, an additional feature of the filter port (3) when the pressure permeable material is wet and saturated by the oil fill from the first oil filled chamber (8), is that it in turn avoids clogging as it prevents the wellbore grouting cement to bind to the pressure permeable material. In an embodiment the pressure permeable material extends from the filter port (3) outside the housing (5), and increases the filter volume. This feature grants the hydraulic connectivity of the sensor to its surroundings.

In an embodiment the pressure permeable material is hemp fiber, and the slit of the filter port (3) is filled with the hemp fiber.

In an alternative embodiment the pressure permeable material consists of a number of pressure permeable capillary tubes extending radially outwards from the slit.

FIGS. 4 and 5 also illustrates the connection line (7) of the pressure sensor (6).

The features above related to the internals of the housing (5) may be combined with any of the previous mentioned embodiments related to features for correction of the pressure signal (p) and communication based on wireless transfer of power and pressure and temperature signals.

The invention claimed is:

1. A pressure gauge system for in-situ determination of a wellbore formation pressure through a layer of cement, said pressure gauge system comprising:

a housing arranged to be permanently installed in said cement on the outside of a wellbore casing, wherein said housing comprises:

a pressure sensor with an output pressure signal, wherein said pressure gauge system further comprises;

a first temperature sensor with a first temperature signal arranged to measure a first temperature outside said wellbore casing;

a computer arranged to receive said pressure signal and said first temperature signal, and calculate a temperature compensated output pressure signal;

a first oil filled chamber;

a second oil filled chamber between said first oil filled chamber and said pressure sensor, arranged to isolate said pressure sensor from said first oil filled chamber; and a pressure permeable filter port through a wall of said housing to allow formation pressure from outside said housing to act on said first oil filled chamber;

wherein said filter port is a slit through said housing.

2. A pressure gauge system according to claim 1, comprising:

a second temperature sensor with a second temperature signal arranged to measure a second temperature inside said wellbore casing, wherein said computer is arranged to receive said second temperature signal, and calculate said temperature compensated output pressure signal also based on said second temperature signal.

3. A pressure gauge system according to claim 1, comprising:

a rate of change temperature sensor with rate of change temperature signal arranged to measure a rate of change of the temperature outside said wellbore casing, wherein said computer is arranged to receive said rate of change temperature signal and calculate said temperature compensated output pressure signal also based on said rate of change temperature signal.

4. A pressure gauge system according to claim 1, comprising:

a first end of a cable connected to said computer, wherein said cable is arranged for transferring electric power to said computer; and a second end of said cable connected to a control unit arranged to receive said output pressure signal from said computer.

5. A pressure gauge system according to claim 1, comprising:

an outer wellbore instrument comprising an outer inductive coupler, wherein said outer wellbore instrument is fixedly arranged on said wellbore casing;

an inner wellbore instrument comprising an inner inductive coupler arranged on the outside of a tubing arranged inside said wellbore casing;

a first end of a cable connected to said inner wellbore instrument, wherein said cable being arranged for transferring electric power to said inner wellbore instrument, and said inner wellbore instrument is arranged to provide inductive power to said outer wellbore instrument, wherein said outer wellbore instrument comprises a power supply for power harvesting said inductive power and for providing power to said computer; and a second end of said cable connected to a control unit arranged to receive said output pressure signal from said computer via said outer wellbore instrument and said inner wellbore instrument.

6. A pressure gauge system according to claim 5, wherein said outer wellbore instrument is arranged on the outside of said wellbore casing.

7. A pressure gauge system according to claim 5, comprising an intermediate casing section coaxially arranged between said wellbore casing and said tubing.

8. A pressure gauge system according to claim 1, wherein said slit is filled with hemp fiber.

9. A pressure gauge system according to claim 1, wherein said second oil filled chamber is partly constituted by a second side of a non-permeable bellows, where a first side of said bellows is arranged to reside in said first oil filled chamber, and an oil in said second oil filled chamber is in fluid contact with said pressure sensor.

10. A method for in-situ determination of a wellbore formation pressure through a layer of cement, wherein said method comprises the following steps:

detecting an output pressure signal from a pressure sensor arranged in a housing permanently installed in said cement on the outside of a wellbore casing;

detecting a first temperature signal from a first temperature sensor arranged to measure a first temperature outside said wellbore casing;

calculating a temperature compensated output pressure signal in a computer, based on said pressure signal and said first temperature signal;

isolating said pressure sensor from a first oil filled chamber with a second oil filled chamber; and allowing formation pressure to act on said first oil filled chamber through a pressure permeable filter port having a slit through a wall of said housing.

11. A method according to claim 10, comprising the steps of:

detecting a second temperature signal from a second temperature sensor arranged to detect a second temperature inside said wellbore casing; and calculating said temperature compensated output pressure signal in said computer based on said pressure signal, said first temperature signal and said second temperature signal.

12. A method according to claim 10, comprising the steps of:

detecting a rate of change of said first temperature in a rate of change temperature sensor with a rate of change temperature signal; and calculating said temperature compensated output pressure signal in said computer also based on said rate of change temperature signal.

13. A method according to claim 10, comprising the steps of:

providing power to said computer via a cable, an inner wellbore instrument, and an outer wellbore instrument, wherein:

said outer wellbore instrument comprises an outer inductive coupler, said outer wellbore instrument is fixedly arranged on said wellbore casing, said inner wellbore instrument comprises an inner inductive coupler arranged on the outside of a tubing arranged inside said wellbore casing, a first end of said cable is connected to said inner wellbore instrument, said cable transfers electric power to said inner wellbore instrument, said inner wellbore instrument provides inductive power to said outer wellbore instrument, said outer wellbore instrument comprises a power supply for power harvesting said inductive power and for providing power to said computer; and receiving said output pressure signal from said computer via said outer wellbore instrument, said inner wellbore instrument and said cable, wherein a second end of said cable is connected to a control unit.

* * * * *